United States Patent [19]

Veys

[11] Patent Number: 4,854,811

[45] Date of Patent: Aug. 8, 1989

[54] BUCKET-BLADE ATTACHMENT FOR TRACTORS

[76] Inventor: Jeff M. Veys, 123 Talkeetna Hts. Rd., Longview, Wash. 98632

[21] Appl. No.: 58,810

[22] Filed: Jun. 5, 1987

[51] Int. Cl.[4] ..... E02F 3/74

[52] U.S. Cl. ..... 414/718; 414/722; 414/728; 414/912; 37/117.5; 37/DIG. 3; 37/DIG. 12; 172/822

[58] Field of Search ..... 414/728, 718, 722, 697, 414/686, 912; 37/117.5, DIG. 3, 12; 172/824, 825, 819, 821, 822

[56] References Cited

U.S. PATENT DOCUMENTS

| | | | |
|---|---|---|---|
| 1,961,011 | 5/1934 | Pearson . | |
| 1,977,817 | 10/1934 | Bird . | |
| 2,216,572 | 10/1940 | Nichols, Jr. | 172/825 X |
| 2,224,725 | 12/1940 | Felt . | |
| 2,308,535 | 1/1943 | Paulsen . | |
| 2,452,408 | 10/1948 | Washbond . | |
| 2,472,223 | 6/1949 | McElhinney et al. . | |
| 2,557,160 | 6/1951 | Thierry . | |
| 2,730,823 | 1/1956 | Cassidy . | |
| 2,749,630 | 6/1956 | Nave . | |
| 2,827,717 | 3/1958 | Duke et al. . | |
| 2,950,550 | 8/1960 | French . | |
| 3,084,461 | 4/1963 | Beckford . | |
| 3,157,099 | 11/1964 | Ulrich | 172/821 X |
| 3,178,046 | 4/1965 | Lull . | |
| 3,327,879 | 6/1967 | Lull . | |
| 3,539,022 | 11/1970 | Berg . | |
| 3,991,832 | 11/1976 | Cooper . | |
| 4,280,783 | 7/1981 | Hayward | 414/718 X |
| 4,306,832 | 12/1981 | Schmiesing | 414/728 X |
| 4,512,090 | 4/1985 | Billings | 414/912 X |
| 4,553,899 | 11/1985 | Magni | 414/728 X |
| 4,633,601 | 1/1987 | Fleck et al. | 414/722 X |

*Primary Examiner*—Robert J. Spar
*Assistant Examiner*—Donald W. Underwood

[57] ABSTRACT

An earthmoving attachment to be mounted on the front end of a tractor. The attachment includes a frame secured to the tractor, arms pivoted to the frame and extending forwardly and mounting a combination bucket and blade. Hydraulic cylinders individually extend telescoping sections in the arms to effect a skewing of the blade. Another hydraulic cylinder mounting a slider adjacent one end of the blade is operable to tilt the blade or bucket. Other sets of hydraulic cylinders tip the bucket and lift the arms conventionally. Simple adjustments are operable to convert the attachment from the configuration of a front-end-loader to that of a dozer, and to skew, tilt and tip the blade and bucket in various configurations.

10 Claims, 4 Drawing Sheets

BUCKET-BLADE ATTACHMENT FOR TRACTORS

BACKGROUND OF THE INVENTI0N

This invention relates to earth moving machinery, and more particularly to an attachment for a tractor providing a bucket and blade which are adjustable to various angular configurations.

Conventional earth moving machinery can be found in many styles and forms, from small tractors and their attachments to large bulldozers and the like. The present invention is especially suitable for small and medium size tractors, although specific size or type of equipment is not a factor herein. Conventional bulldozers having blades which skew or tilt to various angles are complicated in manufacture and operation and are characterized by their heavy weight and poor stability because the center of gravity of the entire machine is displaced from the center of gravity of the tractor.

Attachments for small tractors are also varied, the most common being backhoe devices and scraper blades for the rear of the tractor, and dozer blades and front-end-loader attachments for the front of the tractor. For front end-loaders the most common configuration is that of a frame on the tractor mounting arms on each side thereof, which are pivotable in a plane extending upwardly and forwardly. In the position that the loader is on the ground, the arms extend straight forwardly to the front of the tractor, and then a solidly mounted downwardly extending dogleg mounts a bucket. The bucket is mounted to pivot forward and back. It is desirable to be able to lift the bucket to a high reach overhead, and to do so it is common in prior art equipment to provide elongated arms. But this promotes unsafe conditions in lifting a heavy load at ground level unless the back of the tractor is properly counterweighted.

The above described attachment for a small tractor has many useful purposes, but for many applications it is not able to adopt a useable configuration. For instance, it is sometimes desirable to push dirt as a dozer, but with prior art equipment this requires removing the front-end-loader and then attaching a dozer blade. Such is a complicated and time consuming change. Further, only more complicated and heavy weight dozer blade attachments have the ability to skew so that one side leads as with a grader, or to tilt so that one side is higher than the other.

Accordingly, it is the general object of the present invention to provide an attachment for a tractor, including a wheeled tractor, Caterpillar tractor, or other vehicle, which combines the advantages of a front-end-loader bucket and a dozer blade.

Another object is to provide for skewing the bucket or blade with one side leading the other.

Yet another object is to provide for tilting the blade or bucket so that one side is higher than the other.

A further object is to provide extendable and retractable arms for lifting a load high enough to dump it into a large dumptruck, and yet also to be able to load heavy weights close to the front wheels of the tractor with less counterweighting required.

Yet another object is to provide skewing and tilting operating mechanisms which are light weight so that there is only minimal loss of lifting capacity due to the additional features.

Another object is to provide easily performed adjustments to various configurations.

A further object is to provide the features of a combination bucket-blade assembly, a skewing assembly, and a tilting assembly either individually or all on the same piece of equipment.

A still further object is to provide a device which is able to assume multiples of the various configurations as desired by the operator.

These and other objects and advantages of the present invention and the manner in which they are achieved will become apparent as the present specification proceeds, taken in conjunction with the drawings which illustrate the preferred embodiment.

SUMMARY OF THE INVENTION

In its basic concept, the present invention is an earth-moving attachment for the front end of a tractor, including a frame mounted to the tractor, arms pivoted to the frame and extending forwardly and mounting a combination bucket and blade. Simple adjustments and hydraulic cylinders are operable to convert the attachment from the configuration of a front-end-loader to that of a dozer, and skew, tilt and tip the blade and bucket into various configurations.

BRIEF DESCRIPTION OF THE DRAWINGS

1 is a left side elevation of a tractor, moun attachment of the present invention, and showing in dashed lines alternate positions of the attachment, as it were dumping into a dumptruck or the like.

DESCRIPTION OF THE PREFERRED EMBODIMENT

Figure 1:
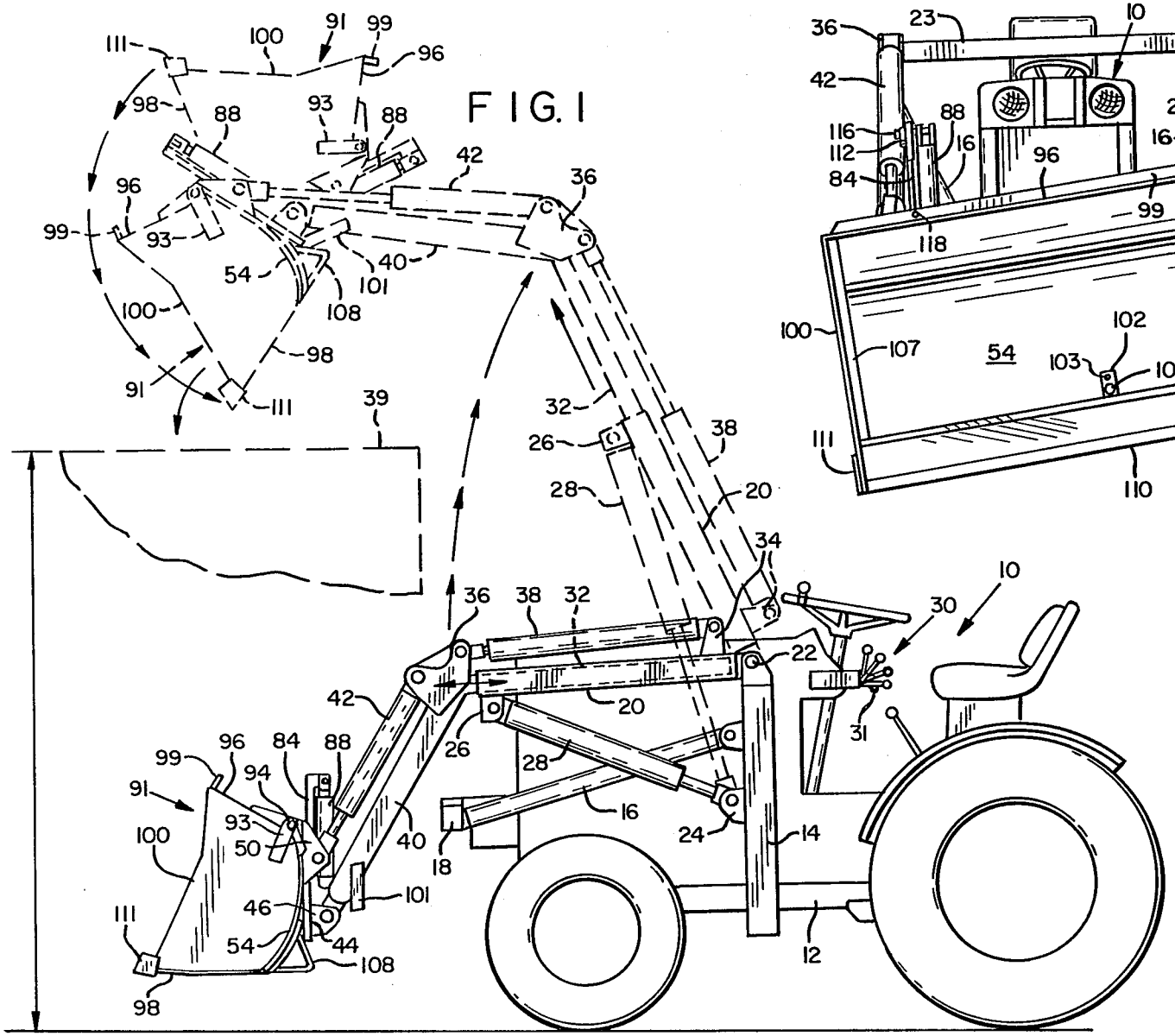

FIG. 1 illustrates a side view of an earth moving attachment for a tractor, which is shown generally at 10. The attachment is of the front-end type and is thus operable generally when the tractor is moving in a forward direction. The tractor sits on a substantially horizontal base plane or ground surface. Of course, the tractor may work on rough ground or a slight sidehill, but for purposes of illustration and description, and so that the various angles of configuration may be described, the tractor is shown level.

The attachment is mounted on a frame including a set of bottom base members 12 secured to the tractor, uprights 14, and braces 16 connecting to a front stabilizing member 18. A similar configuration is on the other side of the tractor.

An arm 20 is pivoted to upright 14 at pivot 22 and is operable to pivot in a plane generally forwardly and upwardly. A bracket 24 is mounted on upright 14 and another bracket 26 is mounted on the arm. Between the brackets is one of a first set of extension means, preferably hydraulic cylinders of common configuration, which is operable to extend to raise the arm to the upwardly angled position shown in dashed lines. A similar one of the first set of hydraulic cylinders is mounted on the other side of the tractor. The tractor operator may control the hydraulics by the operation of one of the levers of controls, shown generally at 30. The controls are of common design, as are the hydraulic hoses and pump system, and are thus not shown in detail.

Figure 3:
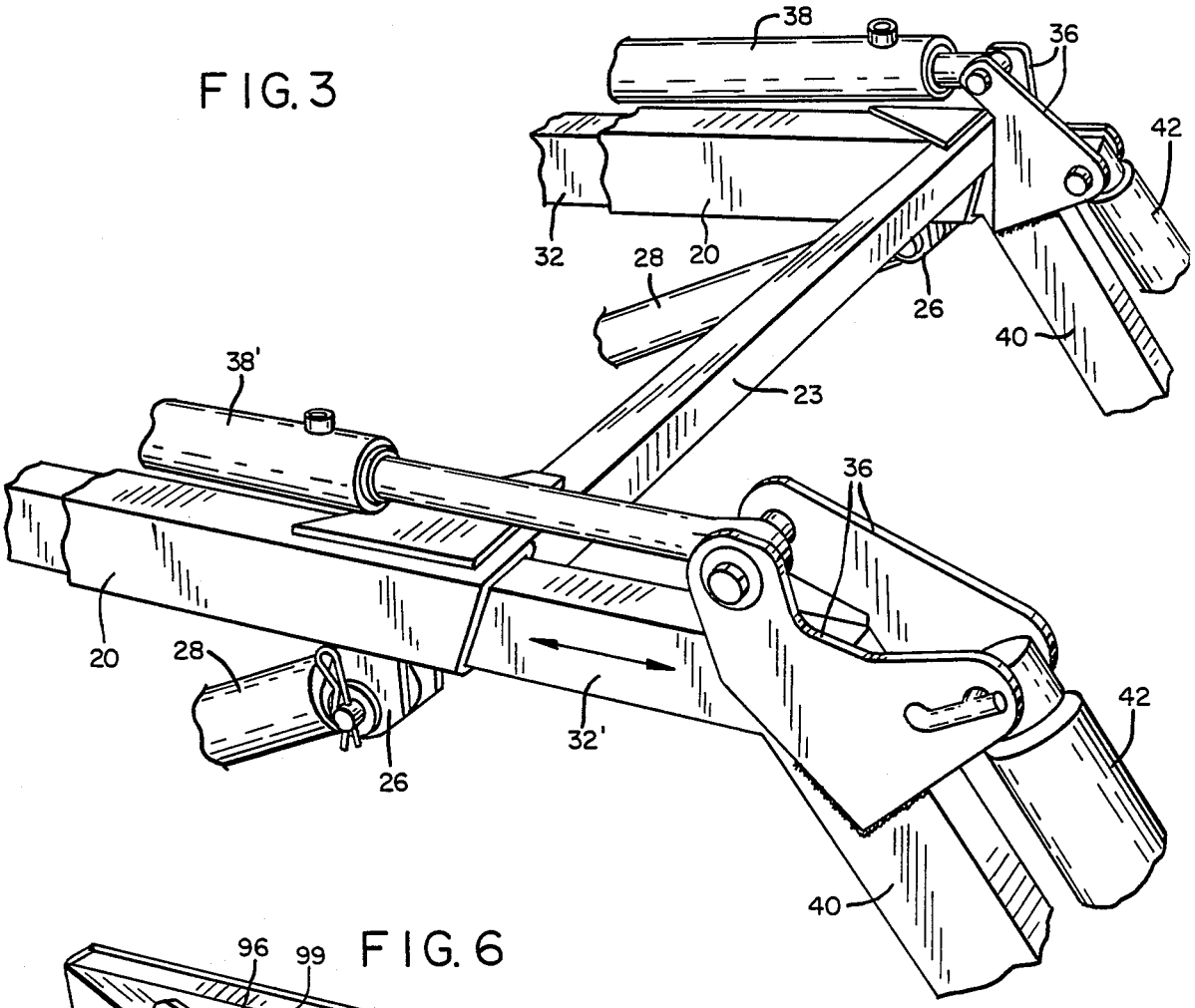
FIG. 3 is a fragmentary perspective view of the arm extension part of the attachment.

Between the ends of the arms 20 on each side of the tractor is a crosspiece 23, as best shown in FIG. 3, which serves to stiffen the arm assembly and insure that cylinders 28 work together.

Preferably arms 20 are tubular, and a telescoping section 32 of a telescoping member of the arm is fitted into each of the tubular arms. lhe fit of the telescoping section is preferably loose or sloppy, the purpose of which will be apparent on further description. An upstanding clevis or bracket 34 is mounted on arm 20 and another bracket 36 is mounted on telescoping section 32. Between these brackets is one of a second set of extension means, preferably hydraulic cylinders 38 which elongate or contract the arm as illustrated by the arrows.

A similar configuration is found on the other side of the tractor, and as illustrated by FIG. 3 the controls 30 are operable to separately or individually act upon each one of the second set of cylinders. For this reason the components which may assume a different configuration from side to side are denoted by primed numerals on the right side, for example 32' and 38''.

Of course, it is possible to operate both cylinders 38 and 38' together, and this is the preferred method of operation when dumping material into a tall truck 39 or the like as shown in FIG. 1. For this purpose, two levers of the controls 30 may be releasably connected by a link 31 so that the cylinders act together. It is also preferred to shorten the arms as much as possible when lifting heavy loads at ground level.

Figure 6:
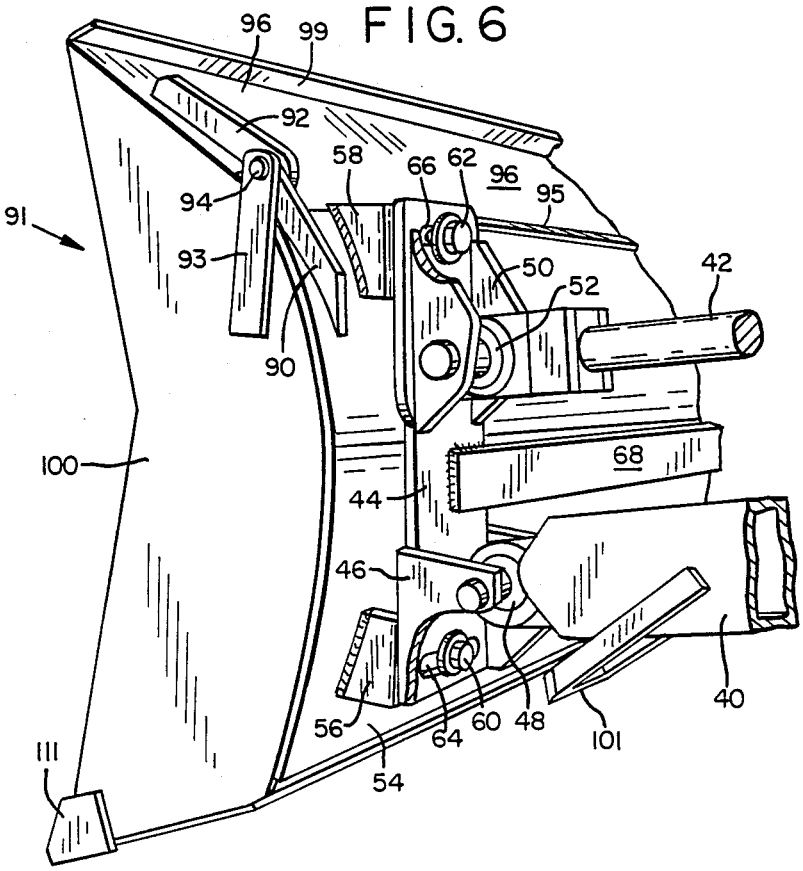
FIG. 6 is a fragmentary perspective view of the opposite end of the back of the blade from that of FIG. 5.

A dogleg section 40 of the telescoping member of the arm 20 is solidly connected to the telescoping section 32. The dogleg section extends generally downwardly and forwardly when the arms 20 are directed forwardly. Substantially parallel to the dogleg sections 40 is a third set of extension means, preferably hydraulic cylinders 42 as shown best in FIG. 5. On the left hand side of the tractor the dogleg and the associated cylinder are both connected to a pivot plate 44 (FIG. 6). A bracket 46 extends from the pivot plate and mounts dogleg section 40 by a ball joint 48. The ball joint provides substantial tipping latitude forward and back, and some sideways latitude, the importance of which will be described further in the specification. The pivot plate also mounts a top bracket 50 which mounts cylinder 42 by means of a similar ball joint 52.

A ground-engaging means is provided which is supported by arms 20 including the telescoping members, which include telescoping sections 32 and dogleg sections 40. Preferably the ground-engaging means is a combination blade and bucket assembly, the blade being denoted as 54 and the portions collectively forming the remainder of the bucket shown generally at 91.

The previously described pivot plate assembly is mounted on blade 54 adjacent one end thereof. Brackets 56 and 58 are secured to the back of the blade, and have holes therein into which are fitted bolts 60 and 62, respectively. The bolts extend through slotted holes 64 and 66, respectively, in the pivot plate 44. The bolts are secured, although not tightly against the pivot plate, by lock nuts behind the brackets. This allows the blade to rock or tilt slightly, pivoting against the pivot plate as the other end of the blade moves up and down.

Figure 5:
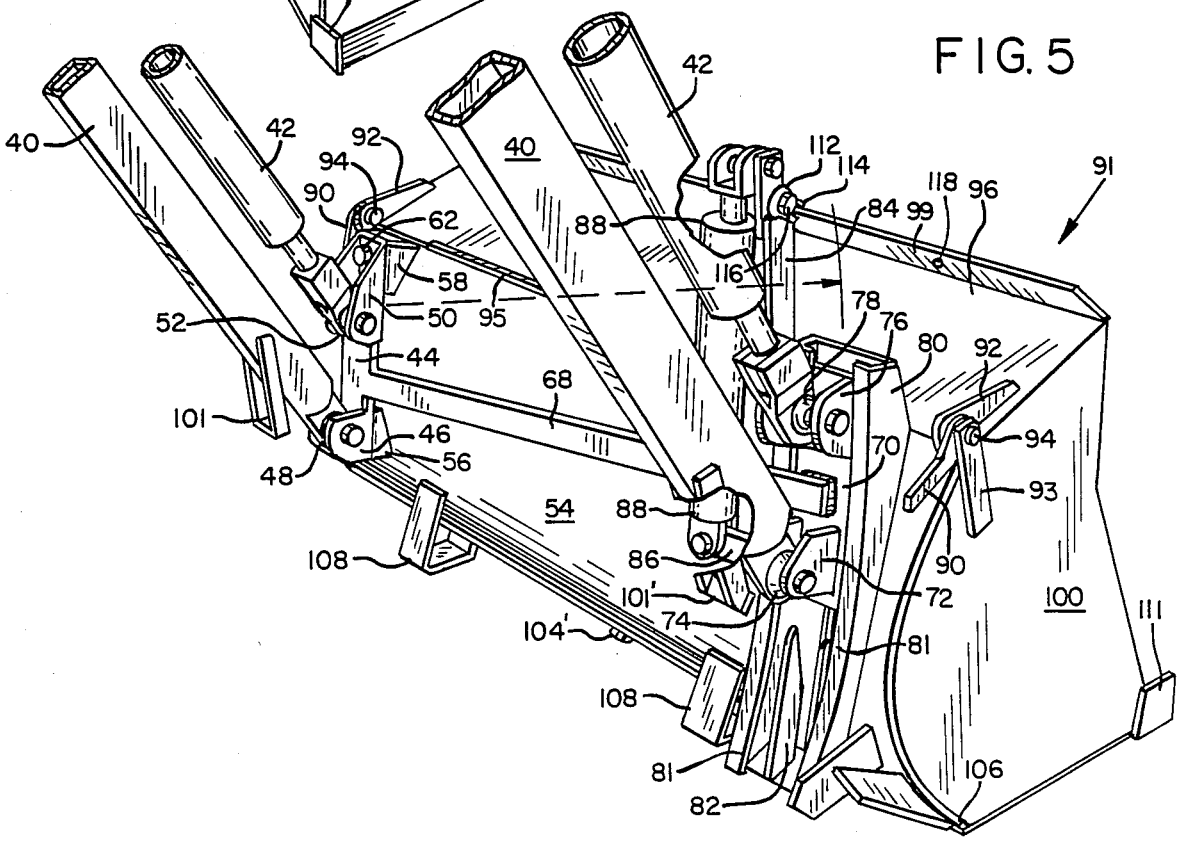
FIG. 5 is a fragmentary perspective view of the back of the blade, showing the tilting mechanism part of the attachment.

On the other end of blade 54 is mounted a slider means as best shown in FIG. 5. The slider means includes a slider track 80 which is secured to the back of blade 54. A slider 70 is operable to move along the track. Attached to the slider is a bracket 72 which mounts the right dogleg section 40 by means of a ball joint 74. Also attached to the slider is bracket 76 mounting cylinder 42 by ball joint 78. The brackets are more narrow than the slider, and the slider track includes ears 81 which prevent the slider from disengaging the track. The slider track also has wedge shaped guides 82 in the bottom of the track which keep the slider adjacent ears 81 even though blade 54 is convex on the back side thereof.

A stabilizing bar 68 extends across the width of the back of blade 54, between the pivot plate 44 and the slider 70. The slider track 80 is flat in the plane of tilting, but is curved on the radius of the distance between the pivot plate 44 and the slider 70.

A fourth extension means is provided for positioning slider 70 along track 80. A bracket 84 is mounted on the back of blade 54 and mounts a hydraulic cylinder 88 between the end thereof and a bracket 86 connected to the slider. The cylinder is actuated by controls 30 to move blade 54 up and down on one end with respect to dogleg 40 of the arm assembly on that side. The center position of cylinder 88 results in slider 70 being positioned centrally on the blade, even with pivot plate 44. Thus the blade is not tilted with respect to the base plane of the tractor. The blade is able to tilt to the same degree, one way or the other.

The bucket assembly 91 generally includes a top plate 96, a bottom plate 98 spaced from the top plate, and side plates 100 on each end thereof connecting the top and bottom plates. The blade 54 forms the back of the bucket. The front of the top plate is reinforced by a lip 99. Similarly, there is a reinforcing ridge 95 along the rear of the top plate, a stabilizing strip 97 on the rear of the bottom plate, and lips 107 on the rear of each of the side plates 100. When the blade is tight against the bucket the top of the blade fits between the top plate and reinforcing ridge 95. The cutting surface 106 of the blade similarly fits into a V-shape between the the bottom plate and stabilizing strip 97. The front bottom edge of the bucket includes a heavy cutting edge 110 and cutting ears 111 on the lower corners. By this construction the overall bucket may be made quite light, but still strong enough to carry large loads. Importantly, the blade serves to prevent the bucket from buckling by fitting into the V-shapes formed by the reinforcing strips.

Figure 7:
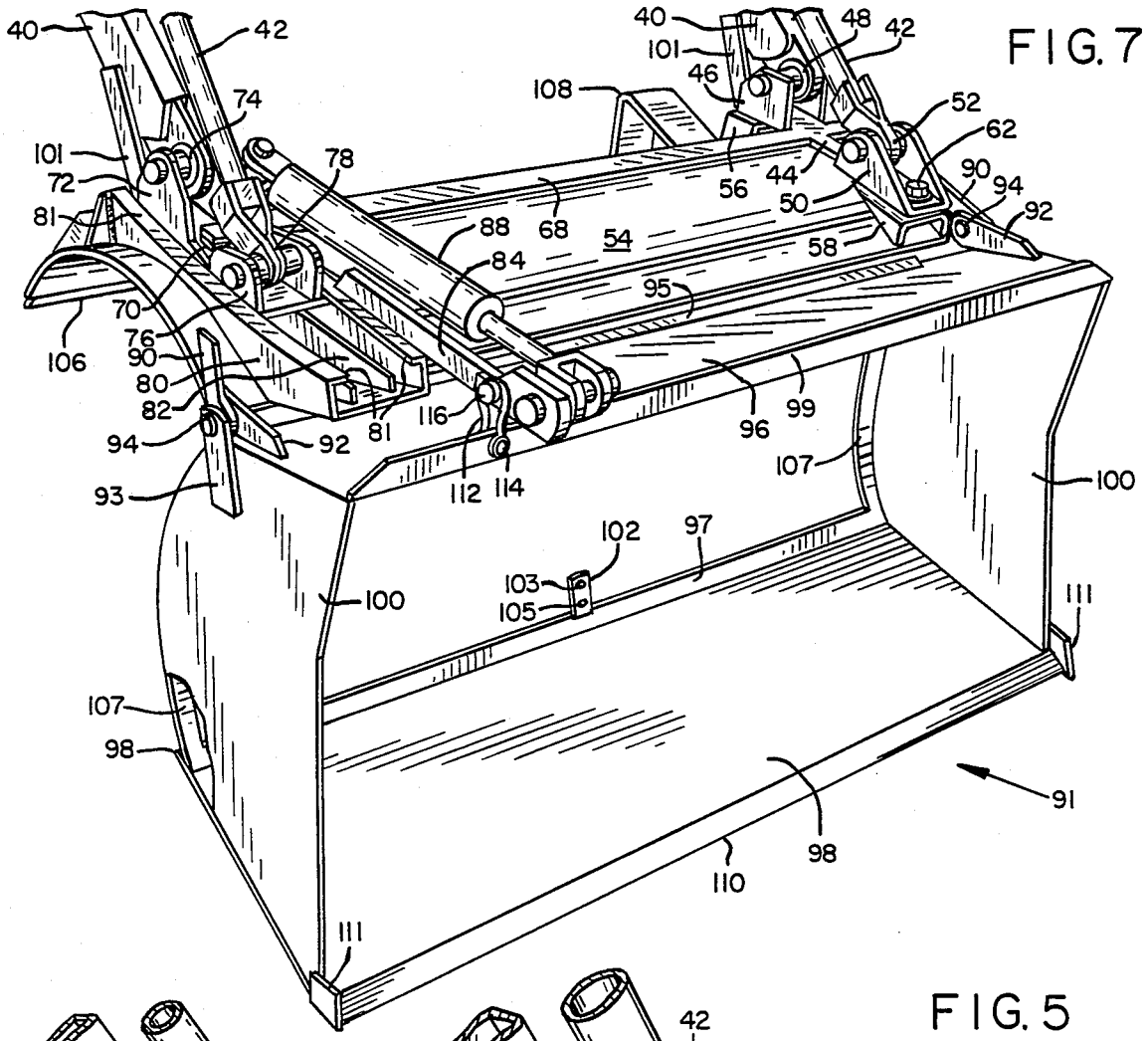
FIG. 7 is a fragmentary perspective view illustrating the separation of the bucket from the blade as when the bucket is fastened to be up away from the blade.

FIG. 7 best shows that the blade 54 is hinged to the bucket 91. Brackets 90 are attached to the back of the blade, and brackets 92 and 93 are attached to the bucket top and sides, respectively. The brackets are pivoted together at 94.

FIG. 7 also shows the blade in its fully forward position, with cylinders 42 extended as far as possible. In this position bumpers 101 and 101', attached to dogleg sections 40 abut the blade or brackets mounted thereto. Thus there is provided a positive stop in all configurations of the assembly.

Stabilizing strip 97 mounts a securing tab 102 in the center of the bucket 91. The tab includes two holes 103 and 105, and there are provided mating holes in the center of the bottom of the blade 54. A first catch means is provided by this assembly and including a bolt 104 which may be extended through one of the holes a the assembly is held in alignment by a hand tool through the other hole. Bolt 104 is fastened with a nut 104'.

Figure 2:
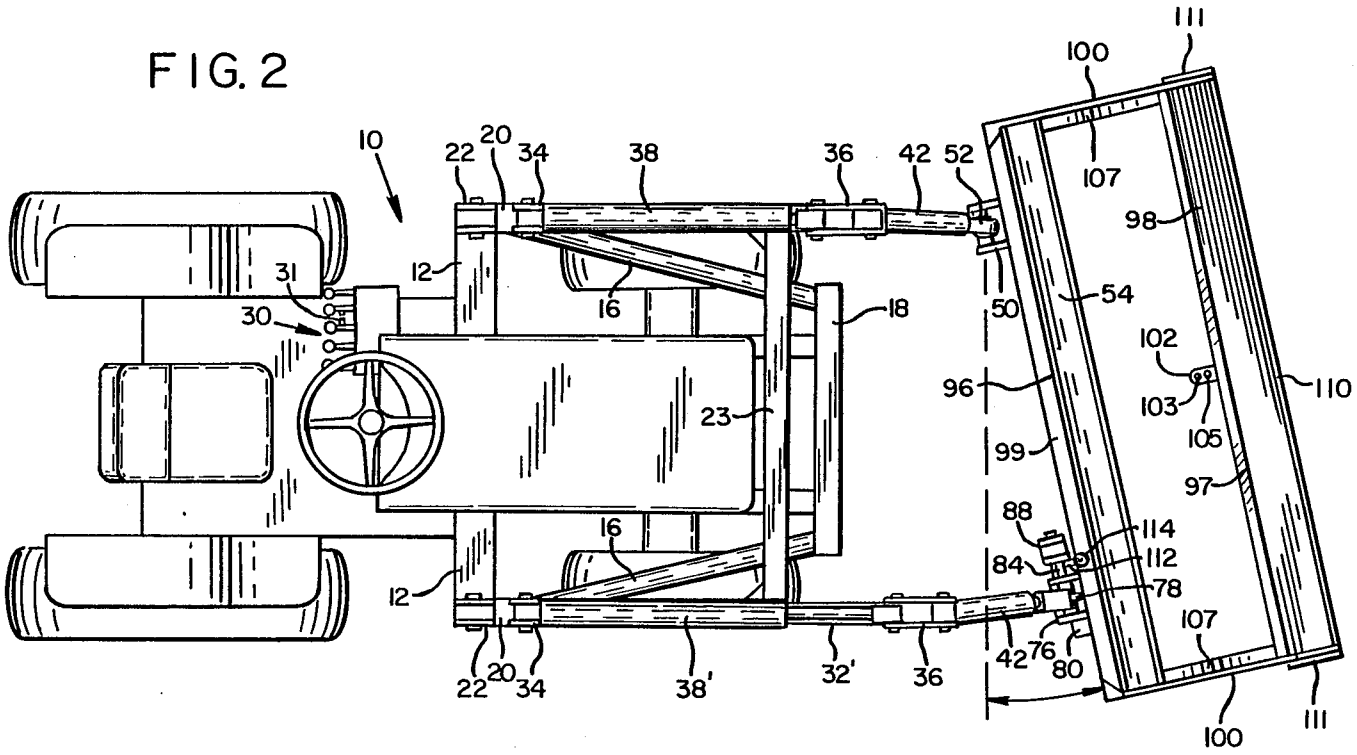
FIG. 2 is a top plan view of the tractor, mounting the of the present invention, herein shown with the bucket part detached from the blade and raised and secured up away from the blade, exposing a dozer blade configuration, it being skewed sideways as a plow or grader blade.

The center of gravity of the bucket is such that when the bucket is not fastened to the blade, and the blade is tipped forwardly as in FIG. 7, the bucket rocks to a position such that it can be fastened up away from the blade by a second catch means. Bracket 84 mounts a stud 116 which provides a mounting point for a U-bolt or clevis 112. A bolt 114 is placed through a hole 118 in lip 99, and fastens with the clevis. FIGS. 2 and 7 show the bucket up away from the blade, and FIGS. 1, 4, 5 and 6 show the bucket attached to the blade.

FIG. 1 best shows that when the blade and bucket are on the ground, skids 108 are provided to keep the bucket from cutting into the ground too deeply. This is important, because sometimes it is desirable to just skim the top of the ground. In that use, the skids provide a guide and keep the bucket or blade from lurching.

OPERATION

The present invention has several operational modes.

First, as illustrated in FIG. 1, it can be used in the same manner as a conventional front-end-loader. However, the present device has the advantage that it can lift to a greater height than prior art loaders. By extending telescoping arms 32, the bucket 91 is able to reach over the height of large dump trucks. This is done with increased safety, since the dirt or other material can be picked up close to the front of the tractor and raised until the arms are at their steepest angle. Then the arms are extended, and the loaded bucket never gets further forward than the scooping position.

FIG. 7 illustrates locking the bucket 91 up away from the blade 54. This is done by unfastening bolt 104, and then tipping the blade to its furthermost forward position. By gravity the bucket swings to the position shown, and then the catch 112,114 can be connected with the hole 118 in lip 99. Thus the apparatus may be used with the blade only as a grader, dozer, snowplow or the like.

FIGS. 2 and 3 illustrate the procedure for skewing the blade 54. The arms are able to telescope independently as shown with telescoping sections 32 and 32'. Thus the right side of the blade (as shown) can be ahead of the left side. Note that this causes a slight foreshortening of the distance between the mounting points of the dogleg sections 40 to the blade 54. This amount is compensated for by the loose fit of the telescoping sections inside of tubular arms 20; the telescoping sections are able to twist slightly, allowing the dogleg sections to angle inward. Ball joints 48, 52, 74 and 78 are also able to angle to accomodate the skewing.

The apparatus is able to skew with either the right side forward or the left side forward. It is advisable to always have one of the telescoping arms completely retracted in order to hold the blade as close to the tractor as possible. While the attachment is shown only having the blade functioning when skewed, it is possible to also use the bucket in this manner.

Figure 4:
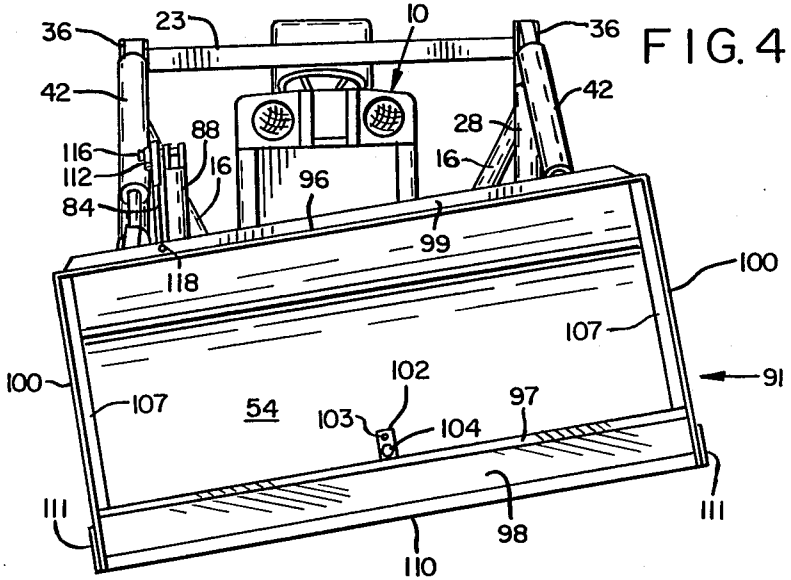
FIG. 4 is a front elevation of the tractor and the attachment of the present invention, herein shown with the bucket tilted at an angle with respect to the base plane of the tractor.

FIGS. 4, 5 and 6 illustrate the ability of the present apparatus to tilt so that one side of the bucket 91 or blade 54 is lower than the other side. The operator sets the hydraulic cylinder 88 to its central position if no tilting is desired, or having greater or lesser extension to produce a tilted blade. It is very useful to be able to manipulate the blade or bucket in this manner for landscaping operations or the like.

Besides the unique functions discussed, it is possible to tip the blade or bucket forward or back by the use of hydraulic cylinders 42 in the manner of a conventional front-end-loader. This is useful in the scooping and dumping operation of FIG. 1, and is also necessary for obtaining the proper angle of attack for grading, scraping and the like.

It should be emphasized that all of the functions of the bucket and blade configurations, including skewing, tilting and tipping may be done separately or in conjunction with each other.

Various modifications may be made in the attachment from that described and shown in the drawings, but such modifictions would still be within the spirit and scope of the present invention.

Having described my invention in its preferred embodiment, I claim:

1. An earth moving attachment for a tractor having a forward direction of movement and a substantially horizontal base plane on which the tractor sits, said attachment providing angular adjustment of a ground engaging means such as a blade or bucket, the attachment comprising:

(a) a frame attached to the tractor;

(b) two arms pivotally mounted on the frame, one on each side of the tractor;

(c) means for pivoting the arms in a plane generally forwardly and upwardly;

(d) two telescoping members, one extending from each of the arms;

(e) means for extending and retracting each of the telescoping members directly forwardly when the ground engaging means is in a ground engaging position, wherein the telescoping members are extendable and retractable together or independently; and (f) ground engaging means attached to the telescoping members by joint means for allowing the ground engaging means to skew with respect to a line perpendicular to the forward direction of the tractor when one telescoping member is extended further than the other, wherein the ground engaging means may be tilted at an angle with respect to the base plane, the attachment further comprising pivot means mounting one of the telescoping members to one end of the ground engaging means, and slider means mounting the other telescoping member to the other end of the ground engaging means, and extension means connected between the other telescoping member and the ground engaging means and being controllable to set the position of the slider to determine the angle of tilt throughout a range of angles with respect to the base plane.

2. The attachment of claim 1 wherein the slider means includes a slider track which is curved on a radius equal to the distance between the pivot means and the slider means.

3. The attachment of claim 1 further comprising a bar connecting the pivot means and the slider means.

4. An earthmoving attachment for a tractor having a forward direction of movement and a substantially horizontal base plane on which the tractor sits, said attachment providing angular adjustment of a ground-engaging means such as a blade or bucket, the attachment comprising:

(a) a frame attached to the tractor;
(b) two arms pivotally mounted on the frame, one on each side of the tractor, each pivoting in a plane generally forwardly and upwardly;
(c) each of the arms being driven in their pivoting motion by one of a first set of hydraulic cylinders attached between the frame and the arm;
(d) said arms being attached to a ground engaging means;
(e) pivot means mounting one of the arms to one end of the ground engaging means;
(f) slider means mounting the other arm to the other end of the ground-engaging means;
(g) an extension means connected between the other arm and the ground-engaging means adjacent the slider means, and being controllable to set the position of the slider to determine the angle of tilt throughout a range of angles with respect to the base plane.

5. The attachment of claim 4 further comprising another set of hydraulic cylinders, each mounted between one of the arms and the ground engaging means, and being substantially parallel to and spaced from the arms, and being able to extend and retract to cause the ground-engaging means to tip forward and back, and having joint means mounted between the ends of the arms and their associated pivot means and slider means, and also between the cylinders and their associated pivot means and slider means.

6. The attachment of claim 5 wherein the ground engaging means is a combination blade and bucket, the blade comprising a plate attached to the arms and being oriented generally vertically to push earth as the tractor is driven, and wherein the bucket comprises a top plate, a bottom plate spaced therefrom and side plates on each end thereof connecting the top and bottom plates, the rear of the bucket being formed by the blade, hinge means connecting the rear of the top plate to the top of the blade so that the bucket may be pivoted up and away from the blade, first catch means for releasably securing the bucket to the blade, and second catch means for releasably securing the bucket up away from the blade.

7. An earthmoving attachment for a tractor having a forward direction of movement, comprising:

(a) a frame attached to the tractor;
(b) two arms pivotally mounted on the frame, one on each side of the tractor, each pivoting in a plane generally forwardly and upwardly;
(c) each of the arms being driven in their pivoting motion by one of a first set of hydraulic cylinders attached between the frame and the arm;
(d) said arms being attached at their forward ends to a ground-engaging means, and wherein said ground-engaging means is a combination blade and bucket;
(e) the blade comprising an elongated plate attached to the arms and being oriented generally vertically to push earth as the tractor is driven;
(f) the bucket comprising a top plate, a bottom plate spaced therefrom and side plates on each end thereof connecting the top and bottom plates, the rear of the bucket being formed by the blade;
(g) hinge means connecting the rear of the top plate to the top of the blade so that the bucket may be pivoted up away from the blade;
(h) first catch means for releasably securing the bucket to the blade;
(i) second catch means for releasably securing the bucket up away from the blade; and
(j) means to tip the blade forward and back, the unsecured bucket having a center of gravity such that when the blade is tipped forwardly the bucket assumes a position such that the second catch means may be directly engaged, and then when the blade is tipped back the bucket is held up away from the blade.

8. An earth moving attachment for a tractor having a foward direction of movement, comprising:

(a) a frame attached to the tractor;
(b) two arms pivotally mounted on the frame, one on each side of the tractor, each pivoting in a plane generally forwardly and upwardly;
(c) each of the arms being driven in their pivoting motion by one of a first set of hydraulic cylinders attached between the frame and the arm;
(d) said arms being attached at their forward ends to a ground-engaging means, and wherein said ground-engaging means is a combination blade and bucket;
(e) the blade comprising an elongated plate attached to the arms and being oriented generally vertically to push earth as the tractor is driven;
(f) the bucket comprising a top plate, a bottom plate spaced therefrom and side plates on each end thereof connecting the top and bottom plates, the rear of the bucket being formed by the blade;
(g) hinge means connecting the rear of the top plate to the top of the blade so that the bucket may be pivoted up away from the blade;
(h) first catch means for releasably securing the bucket to the blade;
(i) second catch means for releasably securing the bucket up away from the blade; and
(j) wherein the first catch means comprises a tab attached to the bucket having at least one hole therein, and a bolt engageable through said at least one hole when the bucket and blade are together and aligned.

9. An earthmoving attachment for a tractor having a forward direction of movement and a substantially horizontal base plane on which the tractor sits, the attachment providing multiple modes of operation including skewing, tilting, tipping, lifting, extending and interchangability of various ground-engaging means such as a blade and bucket, the attachment comprising:

(a) a frame attached to the tractor;
(b) two arms pivotally mounted on the frame, one on each side of the tractor, near the top thereof;
(c) means for pivoting the arms in a plane generally forwardly and upwardly;
(d) a crosspiece attached between the forward ends of the two arms;
(e) two telescoping members, one extending from each of the arms, each telescoping member having a telescoping section which fits along the arm and telescopes in relation thereto and a dogleg section extending from the end of the telescoping section for mounting the ground engaging means;

(f) means for extending and retracting each of the telescoping sections directly forwardly, wherein the telescoping members are extendable and retractable together or independently;

(g) ground-engaging means including a blade and bucket, the blade comprising a plate attached to the telescoping members and being oriented generally vertically to push earth as the tractor is driven, and wherein the bucket comprises a top plate, a bottom plate spaced therefrom and side plates on each end thereof connecting the top plate and the bottom plate, the rear of the bucket being formed by the blade, and hinge means connecting the rear of the top plate to the top of the blade so that the bucket may be pivoted up away from the blade;

(h) pivot means mounting one of the dogleg sections to one end of the back of the blade;

(i) slider means mounting the other doglet section to the other end of the back of the blade;

(j) ball joint means connecting each of the doglet sections to the respective pivot and slider means;

(k) extension means mounted between the telescoping members and the ground-engaging means and being substantially parallel to and spaced from the dogleg sections, and being operable to extend and retract to cause the blade to tip forward and back;

(l) ball joint means mounted between the extension means and the respective pivot and slider means; and (m) tilting extension means connected between the dogleg section and the ground-engaging means adjacent the slider means and being controllable to set the position of the slider to determine the angle of tilt throughout a range of angles with respect to the base plane.

10. An earth moving attachment for a tractor having a forward direction of movement and a substantially horizontal base plane on which the tractor sits, said attachment providing angular adjustment of a ground engaging means such as a blade or bucket, the attachment comprising:

(a) a frame attached to the tractor;

(b) two arms pivotally mounted on the frame, one on each side of the tractor;

(c) means for pivoting the arms in a plane generally forwardly and upwardly;

(d) two telescoping members, one extending from each of the arms;

(e) means for extending and retracting each of the telescoping members directly forwardly when the ground engaging means is in a ground engaging position, wherein the telescoping members are extendable and retractable together or independently; and ground engaging means attached to the telescoping members by joint means for allowing the ground engaging means to skew with respect to a line perpendicular to the forward direction of the tractor when one telescoping member is extended further than the other, wherein the ground engaging means is a combination blade and bucket, the blade comprising a plate attached to the telescoping members and being oriented generally vertically to push earth as the tractor is driven, and wherein the bucket comprises a top plate, a bottom plate spaced therefrom and side plates on each end thereof connecting the top and bottom plates, the rear of the bucket being formed by the blade, and hinge means connecting the rear of the top plate to the top of the blade so that the bucket may be pivoted up away from the blade, and further comprising first catch means for releasably securing the bucket to the blade, and also comprising second catch means for releasably securing the bucket up away from the blade and further comprising means to tip the blade forward and back, the bucket having a center of gravity such that when the blade is tipped forwardly the bucket, released from the first catch means, assumes a position such that the second catch means may be directly engaged, and then when the blade is tipped back the bucket is held up away from the blade.

* * * * *